United States Patent [19]

Hill

[11] 3,950,816

[45] Apr. 20, 1976

[54] CARPET GRIPPER WITH HEADLESS CARPET ANCHORING PINS

[75] Inventor: Harvey J. Hill, Monterey Park, Calif.

[73] Assignee: Roberts Consolidated Industries, Inc., City of Industry, Calif.

[22] Filed: Dec. 6, 1974

[21] Appl. No.: 530,187

[52] U.S. Cl. ..... 16/16

[51] Int. Cl.[2] ..... A47G 27/04

[58] Field of Search ..... 16/16; 29/432.1

[56] References Cited

UNITED STATES PATENTS

| | | | |
|---|---|---|---|
| 2,752,597 | 7/1956 | Kent et al. | 16/16 X |
| 2,821,714 | 2/1958 | Kent et al. | 16/16 UX |

*Primary Examiner*—Werner H. Schroeder
*Assistant Examiner*—Wayne L. Shedd
*Attorney, Agent, or Firm*—Harris, Kern, Wallen & Tinsley

[57] ABSTRACT

A carpet gripper with headless carpet anchoring pins or prongs and a method of making same. A carpet gripper including: a strip having upper and lower surfaces and inner and outer edges; headless carpet anchoring pins or prongs extending upwardly through the strip from the lower surface of the strip through and to a level above the upper surface of the strip; each prong being inclined upwardly and outwardly toward the outer edge of the strip from the lower end of the prong to its upper end; the lower end of each prong being bevelled and having a surface which is obliquely oriented relative to the prong, which is at least generally perpendicular to the upper and lower surfaces of the strip, which faces generally inwardly toward the inner edge of the strip, and which is in a plane extending generally longitudinally of the strip; and the apex of the bevelled lower end of each prong being crimped toward the outer edge of the strip and being embedded in the lower surface thereof.

5 Claims, 12 Drawing Figures

CARPET GRIPPER WITH HEADLESS CARPET ANCHORING PINS

BACKGROUND OF THE INVENTION

The present invention relates in general to so-called tackless carpet grippers and, more particularly, to a carpet gripper with headless carpet anchoring pins or prongs, the invention further relating to a method of making such a carpet gripper.

Prior art representative of carpet grippers with headed carpet anchoring prongs includes my prior U.S. Pat. No. 3,353,204, issued Nov. 21, 1967. Prior art known to me showing carpet grippers with headless carpet anchoring pins or prongs includes the following patents:

| Patentee | Patent No. | Issue Date |
|---|---|---|
| Kent et al | 2,752,597 | July 3, 1956 |
| Maex | 2,806,243 | Sept. 17, 1957 |
| Kent et al | 2,821,714 | Feb. 4, 1958 |
| Maex et al | 2,953,788 | Sept. 27, 1960 |
| Handy | 3,693,212 | Sept. 26, 1972 |

Headed carpet anchoring prongs perform their function very effectively and provide high resistance to failure due to horizontal carpet tension loads, and also high pullout resistance after failure. Prior headless prongs, on the other hand, have much lower failure resistances due to carpet tension, and much lower pullout resistances after failure.

Despite their superior performance to prior headless carpet anchoring prongs, headed prongs suffer the disadvantage of being much more expensive because of the large amount of metal required for the head. In large volume operations, the metal savings resulting from headless prongs can amount to hundreds of thousands of dollars annually. Headless prongs have the further advantage of being drivable from the top surface of the gripper strip, thus avoiding splintering of the top surface. Such splintering caused by headed pins not only reduces the strength of the wood at the base of the pin where it is most needed for support, but the splinters actually hold the base of the carpet up higher on the pin shaft, where leverage is most detrimental to pin stability.

SUMMARY AND OBJECTS OF INVENTION

With the foregoing background in mind, the primary object of the invention is to provide a headless carpet anchoring pin or prong having failure and pullout resistances at least of the same general order of magnitude as those of a conventional headed pin.

More particularly, an important object of the invention is to form and clinch the lower end of a headless carpet anchoring pin or prong in such a way as to provide it with high failure and pullout resistances.

The invention may be summarized as including, and another important object of the invention is to provide a carpet gripper which includes: a strip formed of plywood, for example, having upper and lower surfaces and inner and outer edges; a headless carpet anchoring pin or prong extending upwardly through the strip from the lower surface of the strip through and to a level above the upper surface of the strip; the prong being inclined upwardly and outwardly toward the outer edge of the strip from the lower end of the prong to its upper end; the lower end of the prong being bevelled and having a surface which is obliquely oriented to the axis of the prong, which is at least generally perpendicular to the upper and lower surfaces of the strip, which faces inwardly toward the inner edge of the strip, and which is in a plane extending longitudinally of the strip; and the apex of the bevelled lower end of the prong being crimped toward the outer edge of the strip and being embedded in the lower surface thereof.

In other words, the bevelled lower end of the carpet anchoring prong is provided with a reverse crimp, which is an important feature of the invention.

Another object is to provide a carpet anchoring prong the upper end of which is bevelled and provided with an oblique surface parallel to the oblique surface of the lower end of the prong and facing outwardly toward the outer edge of the strip. With this construction, the carpet anchoring prongs can be formed very simply by making parallel cuts through a length of wire, with no wasted material, which is an important feature.

A further object of the invention is to provide a carpet anchoring pin or prong wherein the angle of the oblique surfaces at the ends of the prong relative to the axis of the prong, i.e., the included angle of the points, is between about 15° and about 35°.

An additional object is to provide a carpet gripper wherein the angle of the pin or prong from the horizontal is between about 45° and about 75 °.

Still another object is to provide combinations of prong point angles and prong angles from the horizontal which achieve the desired reverse crimp, which provide desirable carpet hooking and holding characteristics, which result in the most economical use of wire, which are most desirable from the manufacturing feasibility and tooling life standpoints, and the like. A related object is to provide an optimum combination of the point angle and the angle of the pin from the horizontal which takes into consideration the foregoing parameters.

The invention may be further summarized as including, and another object is to provide a method of making a carpet gripper which includes: placing on an anvil the lower surface of a strip having upper and lower surfaces and inner and outer edges; and driving a headless carpet anchoring prong downwardly through the strip and against the anvil with the prong inclined upwardly and outwardly toward the outer edge of the strip from the lower end of the prong to its upper end, the lower end of the prong being bevelled and having a surface which is obliquely oriented relative to the prong, which is at least generally perpendicular to the upper and lower surfaces of the strip, which faces inwardly toward the inner edge of the strip, and which is in a plane extending lengthwise of the strip, whereby engagement of the apex of the bevelled lower end of the prong with the anvil crimps the apex outwardly toward the outer edge of the strip and embeds same in the lower surface thereof.

The foregoing objects, advantages, features and results of the present invention, together with various other objects, advantages, features and results thereof which will be evident to those skilled in the carpet gripper art in the light of this disclosure, may be achieved with the exemplary embodiment of the invention illustrated in the accompanying drawings and described in detail hereinafter.

GENERAL BACKGROUND

Figure 1:
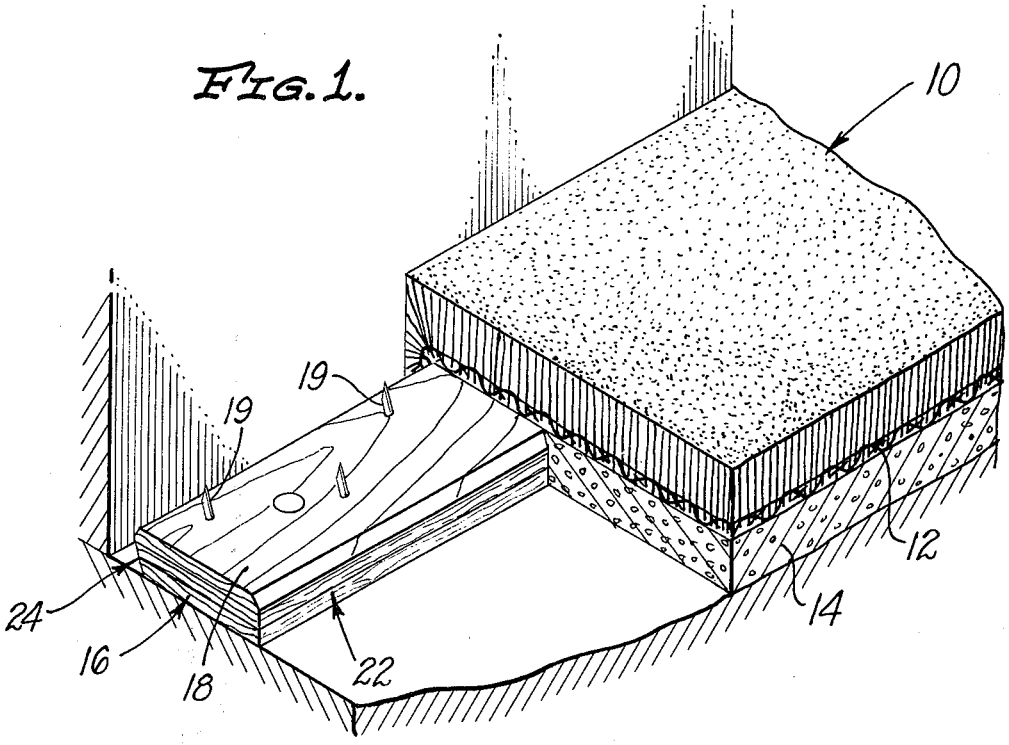
FIG. 1 is a fragmentary perspective view of a carpeting installation with portions of a carpet and a pad removed to expose the carpet gripper.

Referring initially to FIG. 1 of the drawings, illustrated therein is a carpeting installation 10 which includes a carpet 12 overlying a pad 14 and secured along its edge by a carpet gripper 16 which includes a gripper strip 18 having headless prongs 19 on which the carpet 12 is hooked. Except for the headless prongs 19, the carpeting installation 10, including the strip 18, is similar to that shown in my aforementioned patent, so that no detailed description is necessary herein.

Figure 2:
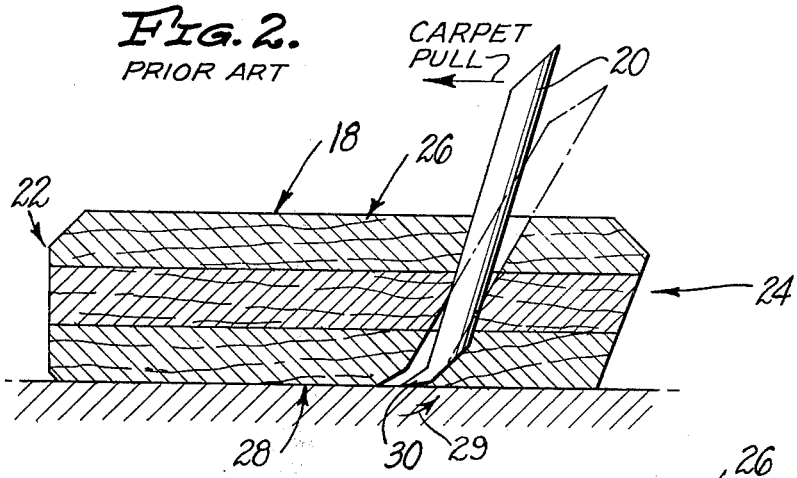
FIG. 2. PRIOR ART
FIG. 2 is a transverse sectional view of a carpet gripper showing a prior-art headless carpet anchoring prong or pin before failure in broken lines and after partial failure in solid lines.

Turning now to FIG. 2 of the drawings, the gripper strip 18 may be formed of plywood, as shown, or any other suitable material. Preferably, it has the cross section disclosed and claimed in my prior patent, although this is not essential to the present invention. For reference purposes, the gripper strip 18 will be regarded as having inner and outer edges 22 and 24 and upper and lower surfaces 26 and 28. For further reference, the outer edge 24 of the strip 18 is that edge thereof nearest the corresponding carpet edge.

PRIOR ART

FIG. 2 of the drawings shows a prior-art headless pin 20 which is essentially that of the hereinbefore-identified Maex U.S. Pat. No. 2,806,243. The pin 20 is shown in its normal position in phantom, and is shown in solid lines as having been partially pulled out of the gripper strip 18, as by carpet tension applied thereto in the direction indicated by the correspondingly labelled arrow.

It will be noted that the lower end of the pin 20 is provided with a crimp which extends toward the inner edge 22 of the gripper strip, the oblique lower end of the pin 20 originally having faced outwardly toward the outer edge 24 thereof. With the crimp 30 oriented toward the inner edge 22 of the strip 18, it will be seen that, once the pin 20 has been displaced from the broken line position to the solid line position by carpet tension, or the like, the pin 20 has very little residual pullout resistance. Further, as indicated by the arrow 29, the lower end of the pin 20 tends to move not only in a direction opposite to the direction of the carpet pull, but upwardly as well. Thus, once the prior-art headless pin 20 is displaced from its initial, broken-line position, its residual pullout resistance is virtually nonexistent, which is a serious drawback of this prior construction. Also, the pins 20 often will stick in the carpet when it is removed, even when it is lifted temporarily during the installation procedure.

DESCRIPTION OF EXEMPLARY EMBODIMENTS OF INVENTION

Figure 3:
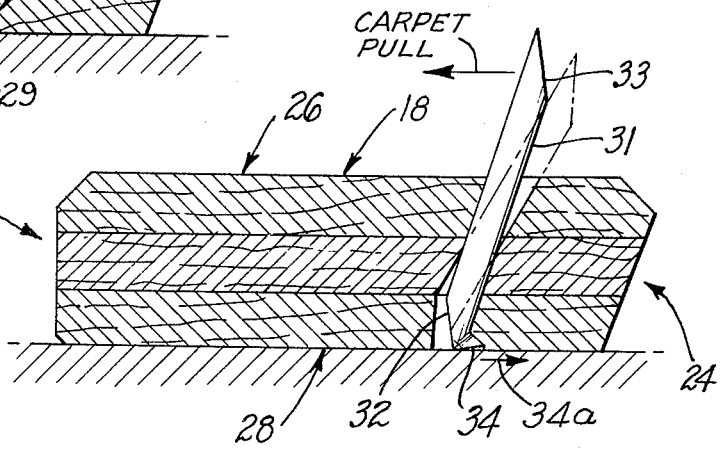
FIG. 3 is a view similar to FIG. 2, but showing a headless carpet anchoring prong or pin of the invention before failure in broken lines and after partial failure in solid lines.
Figure 3A:
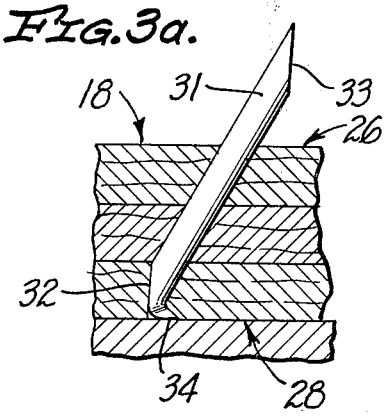
FIG. 3*a* is a fragmentary transverse sectional view duplicating a portion of FIG. 3, but showing the headless pin of the invention before failure.

Turning now to FIGS. 3 and 3*a* of the drawings, illustrated therein is a headless carpet-anchoring prong or pin 31 of the invention which overcomes the foregoing and various other disadvantages of the prior art. The pin 31 of the invention is shown in broken lines in its initial position in FIG. 3 (and in solid lines in its initial position in FIG. 3*a*), and is shown in solid lines in FIG. 3 in a position wherein it has been displaced relative to the strip 18 to some extent, as by carpet tension. It should be noted that, due to a reverse crimp 34, the lower end of the pin 31 does not move upwardly, attention being directed to the arrow 34*a*. Thus, even though the pin 31 has been displaced in this fashion, its pullout resistance is still quite high, due to the reverse crimp 34, as will be apparent from FIG. 3.

Figure 11:
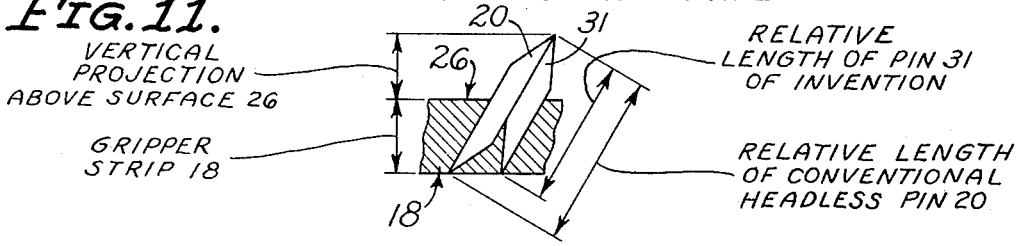
FIG. 11 is a semidiagrammatic transverse sectional view showing the relative lengths of a prior headless pin and the headless pin of the invention, for the same vertical projection above the gripper strip.

More particularly, each pin 31 is preferably simply a length of nail wire provided with a bevelled lower end having a surface 32 which is obliquely oriented relative to the axis of the prong, which is at least generally perpendicular to the upper and lower surfaces 26 and 28 of the strip, which faces generally inwardly toward the inner edge 22 of the strip, and which is generally in a plane extending lengthwise of the strip. Preferably, the upper end of the prong is similarly bevelled and provided with an oblique surface 33 parallel to the oblique surface 32 and facing generally outwardly toward the outer edge 24 of the strip 18. Making the oblique surfaces 32 and 33 parallel permits forming the pins very simply by making parallel oblique cuts in a length of nail wire, completely eliminating any wastage. For the same vertical projection above the upper surface 26 of the strip 18, the pin 31 can be shorter in overall length, so that about 10% more pins 31 can be made from a given length of wire, as compared to the prior art pins 20. This will be clear from FIG. 11 of the drawings.

The bevelled upper ends of the prongs 31 are, of course, sharp enough to penetrate the carpet 12. In fact, as will be apparent from a comparison of the broken lines of FIG. 3 with those in FIG. 2, the pin 31 will penetrate carpeting much more readily than the pin 20. In effect, the pin 31 will penetrate easier due to the different orientation of the face 33, in relation to a downward force on the carpet.

Figure 4:
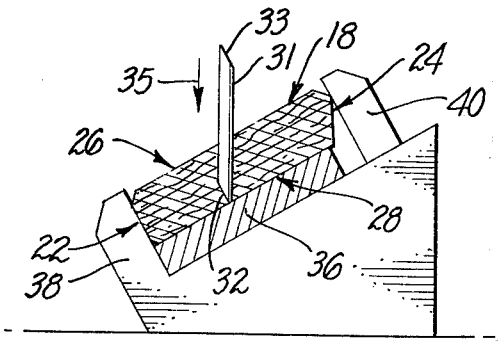
FIGS. 4 and 5 are transverse sectional views showing two methods of driving carpet anchoring pins or prongs of the invention, the prongs being shown only partially driven in these figures.
Figure 5:
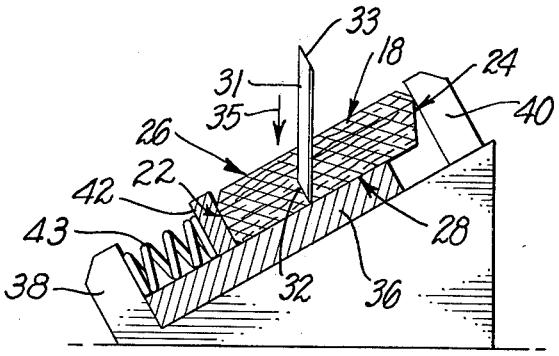

In FIGS. 4 and 5, one of the prongs 31 is shown being driven into and through the gripper strip 18, as diagrammatically indicated by the arrow 35. As the tip of the lower end of the prong 31 penetrates the lower surface 28 of the gripper strip 18, it encounters an anvil 36 which, because of the hereinbefore-described orientation of the surface 32, causes the lower tip of the prong 31 to bend reversely to provide the reverse crimp 34, as shown in FIG. 3. The ultimate result is that the lower tip of the prong 31 is reversely crimped or clinched, i.e., crimped toward the outer strip edge 24, and is embedded in the lower surface 28 of the strip 18.

The specific configuration of the lower end of the prong 31, which produces the reverse clinch 34 upon engagement with the anvil 36, provides the prong with a high failure resistance to horizontal carpet tension forces, and a high pullout resistance even after failure, or partial failure, as will be clear from FIG. 3, which are important features.

To permit driving the pins 31 into the strip 18 vertically downwardly, the strip 18 and the anvil 36 are preferably supported at an angle between members 38 and 40, as shown in FIGS. 4 and 5. Referring to FIG. 5, it is advantageous in obtaining the desired reverse crimp 34 to insert a spring loaded, longitudinally extending member 42, biased toward the inner edge 22 of the gripper strip 18 by longitudinally spaced springs 43, between the inner edge of the gripper strip and the lower support 38. In driving the pin 31, the resiliently biased member 42 yields to permit the strip 18 to slide downwardly on the anvil 36 slightly, thereby further insuring that the desired reverse crimp 34 at the lower end of the pin 31 is obtained.

For optimum results, the angle of the oblique surfaces 32 and 33 relative to the axis of the prong 31, i.e., the included angle of the points of the pin, should be between about 15° and about 35°, and the angle of the prong relative to the horizontal, when the strip 18 is horizontal, should be between about 45° and about 75°.

Figure 6:
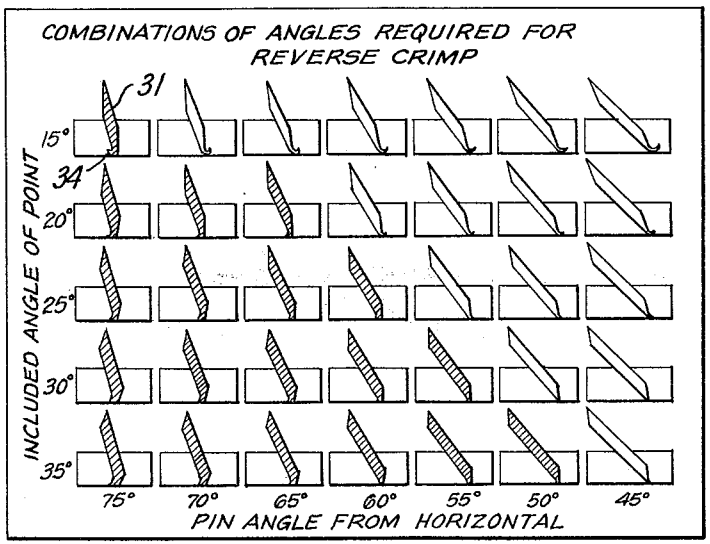

FIG. 6 shows the combinations of point angles and pin angles from the horizontal which will and will not achieve the desired reverse crimp 34. The combinations of point angles and pin angles from the horizontal which will achieve the desired reverse crimp 34 are represented by crosshatched or shaded prongs 31.

Figure 7:
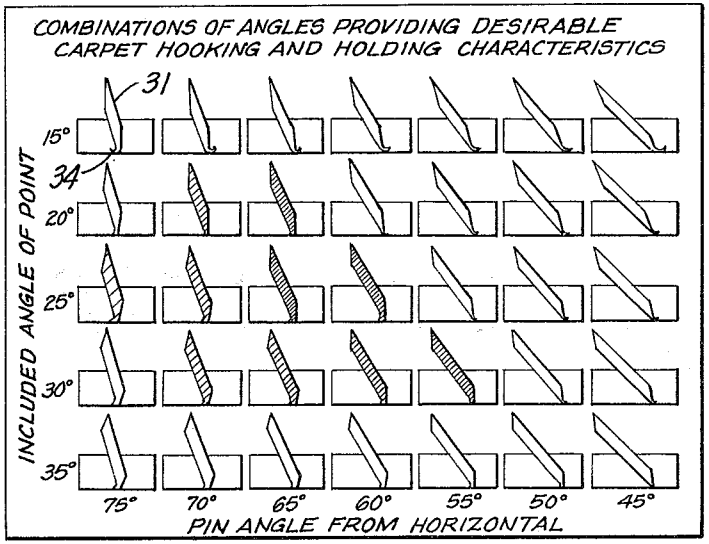
FIGS. 6, 7, 8 and 9 show combinations of prong point angles and prong angles from the horizontal which achieve various characteristics indicated in the titles of these figures.

FIG. 7 shows the combinations of point angles and pin angles from the horizontal which provide desirable carpet hooking and holding characteristics. In those cases where the pins 31 are not crosshatched, the hooking and holding characteristics are less desirable. The more desirable hooking and holding characteristics are represented by cross-hatching the pins 31. The darker the crosshatching is, the more desirable the hooking and holding characteristics are.

Figure 8:
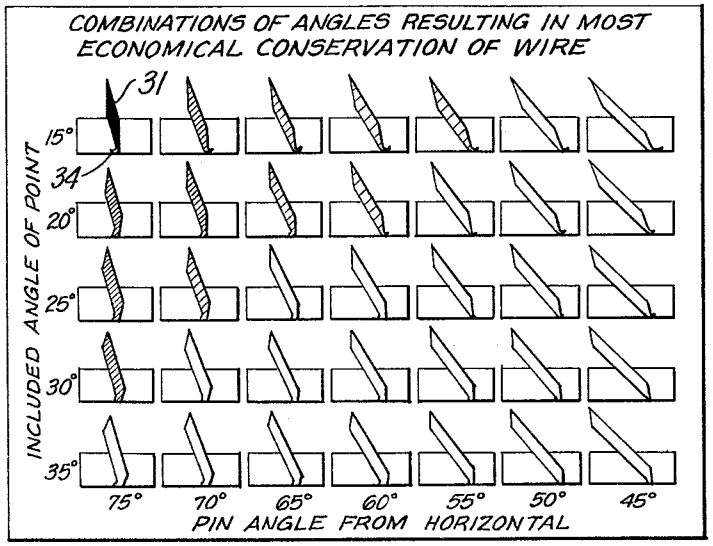

Turning to FIG. 8, the crosshatched pins 31 represent the combinations of point angles and pin angles from the horizontal which result in the most economical use of wire. Again, the darker the crosshatching, the more economical the wire use.

Figure 9:
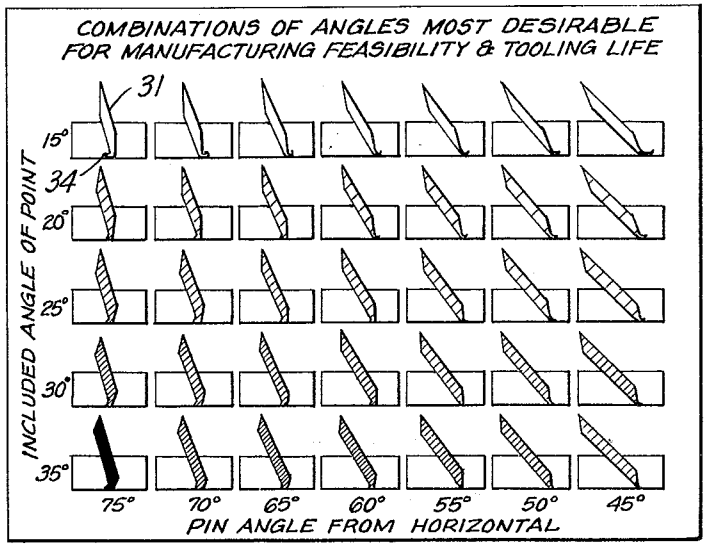

Going to FIG. 9, illustrated therein are combinations of angles which are most desirable from the standpoint of manufacturing feasibility and tooling life. Again, the darker the crosshatching of the pins 31, the more desirable are the manufacturing feasibility and the tooling life.

Figure 10:
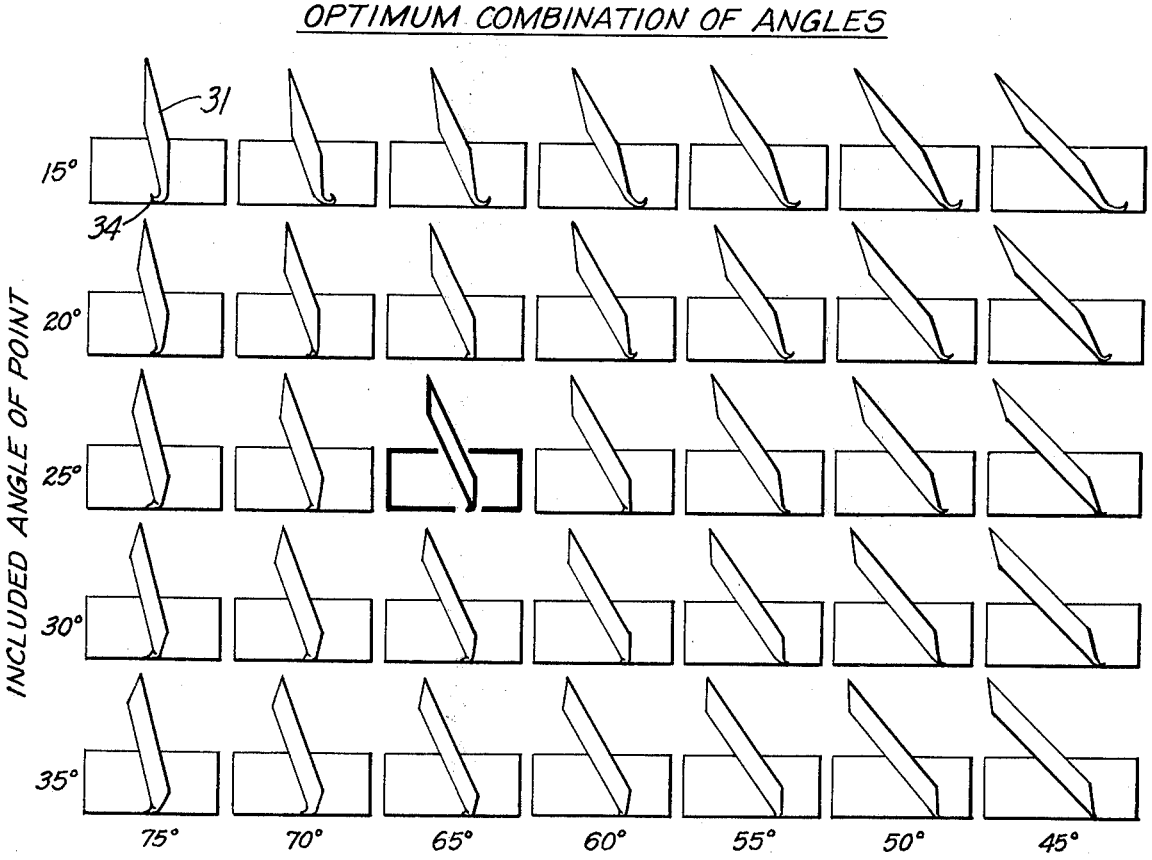
FIG. 10 is a view similar to FIGS. 6 to 9, but indicating an optimum combination of the prong point angle and the prong angle from the horizontal.

FIG. 10 is a composite of FIGS. 6, 7, 8 and 9. In other words, FIG. 10 indicates the optimum combination of the point angle and the pin angle from the horizontal which achieves the desired reverse crimp 34, and which achieves the most desirable characteristics of FIGS. 7, 8 and 9. This optimum angle combination involves a point angle of about 25° and a pin angle from the horizontal of about 65°.

Although the gripper strip 18 is shown as formed of three-ply plywood, it may also be formed of other materials capable of having the prongs 31 driven therethrough and reversely clinched.

Although exemplary embodiments of the invention have been disclosed for illustrative purposes, it will be understood that various minor changes, modifications and substitutions may be made in such embodiments without departing from the invention as hereinafter claimed.

I claim as my invention:

1. In a carpet gripper, the combination of:

a. a strip having upper and lower surfaces and inner and outer edges;

b. a headless carpet anchoring prong extending upwardly through said strip from said lower surface of said strip through and to a level above said upper surface of said strip;

c. said prong being inclined upwardly and outwardly toward said outer edge of said strip from the lower end of said prong to its upper end;

d. said lower end of said prong being bevelled and having a surface which is obliquely oriented relative to the axis of said prong, which is at least generally perpendicular to said upper and lower surfaces of said strip, which faces generally inwardly toward said inner edge of said strip, and which is in a plane extending generally longitudinally of said strip; and e. the apex of said bevelled lower end being crimped toward said outer edge of said strip and being embedded in said lower surface thereof.

2. A carpet gripper as defined in claim 1 wherein said upper end of said prong is bevelled and provided with an oblique surface parallel to said oblique surface of said lower end of said prong and facing outwardly toward said outer edge of said strip.

3. A carpet gripper as set forth in claim 2 wherein the angle of said oblique surfaces relative to the axis of said prong, i.e., the point angle of said prong, is between about 15° and about 35°.

4. A carpet gripper according to claim 3 wherein the angle of said prong from the horizontal when said strip is horizontal is between about 45° and about 75°.

5. A carpet gripper as defined in claim 2 wherein the point angle of said prong is about 25° and the angle of said prong from the horizontal is about 65°.

* * * * *